US011040367B2

(12) United States Patent
Guffey et al.

(10) Patent No.: US 11,040,367 B2
(45) Date of Patent: Jun. 22, 2021

(54) SPRAY RACK SYSTEM

(71) Applicant: Guffey Systems, LLC, Seymour, TN (US)

(72) Inventors: Nathan D. Guffey, Seymour, TN (US); Benjamin D. Nibali, Alcoa, TN (US); Lukas R. Bearden, Alcoa, TN (US); Kenny D. Guffey, Seymour, TN (US)

(73) Assignee: Guffey Systems, LLC, Seymour, TN (US)

( * ) Notice: Subject to any disclaimer, the term of this patent is extended or adjusted under 35 U.S.C. 154(b) by 262 days.

(21) Appl. No.: 16/108,731

(22) Filed: Aug. 22, 2018

(65) Prior Publication Data

US 2020/0061657 A1 Feb. 27, 2020

(51) Int. Cl.
*B05B 13/02* (2006.01)
*B25B 11/00* (2006.01)

(52) U.S. Cl.
CPC ..... *B05B 13/0264* (2013.01); *B25B 11/00* (2013.01)

(58) Field of Classification Search
CPC ..... B05B 13/0285; B05B 13/0292; B05B 13/0264; B05C 13/00; B05C 13/02; B25B 11/00; B25H 1/00; B25H 1/0042; B25H 1/10; B25H 1/08; B25H 3/04; Y10S 269/905
See application file for complete search history.

(56) References Cited

U.S. PATENT DOCUMENTS

| | | | | |
|---|---|---|---|---|
| 4,239,015 | A | 12/1980 | Novello et al. | |
| 4,838,199 | A | 6/1989 | Weber | |
| 5,568,954 | A | 10/1996 | Burgess | |
| 5,894,945 | A * | 4/1999 | Curran | B25B 11/00 211/162 |
| 6,197,175 | B1 | 3/2001 | Kisi et al. | |
| 6,669,037 | B1 * | 12/2003 | Ahn | A47F 5/137 211/189 |
| 6,673,153 | B2 | 1/2004 | Ehrenleitner et al. | |
| 6,702,130 | B1 * | 3/2004 | Carlilse | B05B 13/0285 118/500 |
| 7,798,095 | B2 | 9/2010 | Navarro | |
| 8,136,475 | B2 | 3/2012 | Davis et al. | |
| 8,453,597 | B2 | 6/2013 | Ansorge et al. | |

* cited by examiner

*Primary Examiner* — Tyrone V Hall, Jr.
(74) *Attorney, Agent, or Firm* — Pitts & Lake, P.C.

(57) ABSTRACT

A rack system for retaining and maneuvering items to be spray-coated, including car members configured to support the items to be spray-coated, multiple attachment devices configured to mate with the one or more car members and attach to the items to be spray-coated, a horizontal rail configured to support the one or more car members and to provide a channel for the one or more car members to move along a length of the horizontal rail.

18 Claims, 12 Drawing Sheets

SPRAY RACK SYSTEM

FIELD OF INVENTIVE CONCEPT

The present general inventive concept relates to systems and methods of retaining and maneuvering cabinetry, wood products or other items for purposes of applying or spraying coating materials to surfaces of such items.

BACKGROUND

Known systems and apparatuses for spraying, painting, or coating cabinetry, wood products or other items to be surface finished, have been less than satisfactory in facilitating quick and easy handling, processing, and maneuvering of such items. Improvement is desired in the handling, maneuvering, and support of such items to increase efficiency, throughput, and quality of the spraying, painting, and/or coating process.

BRIEF SUMMARY

Example embodiments of the present general inventive concept provide a system for retaining and maneuvering wood products, cabinetry items, or other items to be spray-coated, including a rack having a horizontal rail to hang one or more of the items, one or more car members coupled to the horizontal rail such that the one or more car members move along a length of the horizontal rail, and one or more attachment devices removably attachable to the one or more car members and to the one or more items.

Example embodiments of the present general inventive concept also provide a system for retaining and maneuvering items to be spray-coated, including one or more movable racks each having a first horizontal rail to support a plurality of items to be spray-coated and a first channel disposed along a length of the first horizontal rail, one or more car members coupled to the at least one rail such that the one or more car members are configured to move along the first channel of the first horizontal rail and to rotate in multiple distinct positions about an axis perpendicular to the length of the first horizontal rail, one or more attachment devices removably attachable to the one or more car members and the one or more items to be spray coated, respectively, such that the one or more items to be spray-coated hang from the first horizontal rail when the one or more car members are coupled to the first horizontal rail and the attachment devices are respectively attached to the one or more car members and items to be spray coated, a movable base configured to support the first horizontal rail, and one or more fixed racks each having a second horizontal rail and a second channel disposed along a length of the second horizontal rail, the second channel being configured to mate with the first channel to facilitate movement of one or more of the car members between the first channel and the second channel.

BRIEF DESCRIPTION OF THE FIGURES

The following example embodiments are representative of exemplary techniques and structures designed to carry out the objectives of the present general inventive concept, but the present general inventive concept is not limited to these example embodiments. Moreover, in the accompanying drawings and illustrations, the sizes and relative sizes, shapes, and qualities of lines, entities, and regions may be exaggerated for clarity. A wide variety of additional embodiments will be more readily understood and appreciated through the following detailed description of the exemplary embodiments, with reference to the accompanying drawings in which.

DETAILED DESCRIPTION

Reference will now be made to the example embodiments of the present general inventive concept, examples of which are illustrated in the accompanying drawings and illustrations. The example embodiments are described herein in order to explain the present general inventive concept by referring to the figures.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Although example embodiments the present general inventive concept will be particularly described as being applied to a system for applying coatings to cabinets or wood products, it will be appreciated that the present general inventive concept can be applied to a variety of other objects, for example furniture, windows, models, and can be made of materials other than wood.

Figure 1:
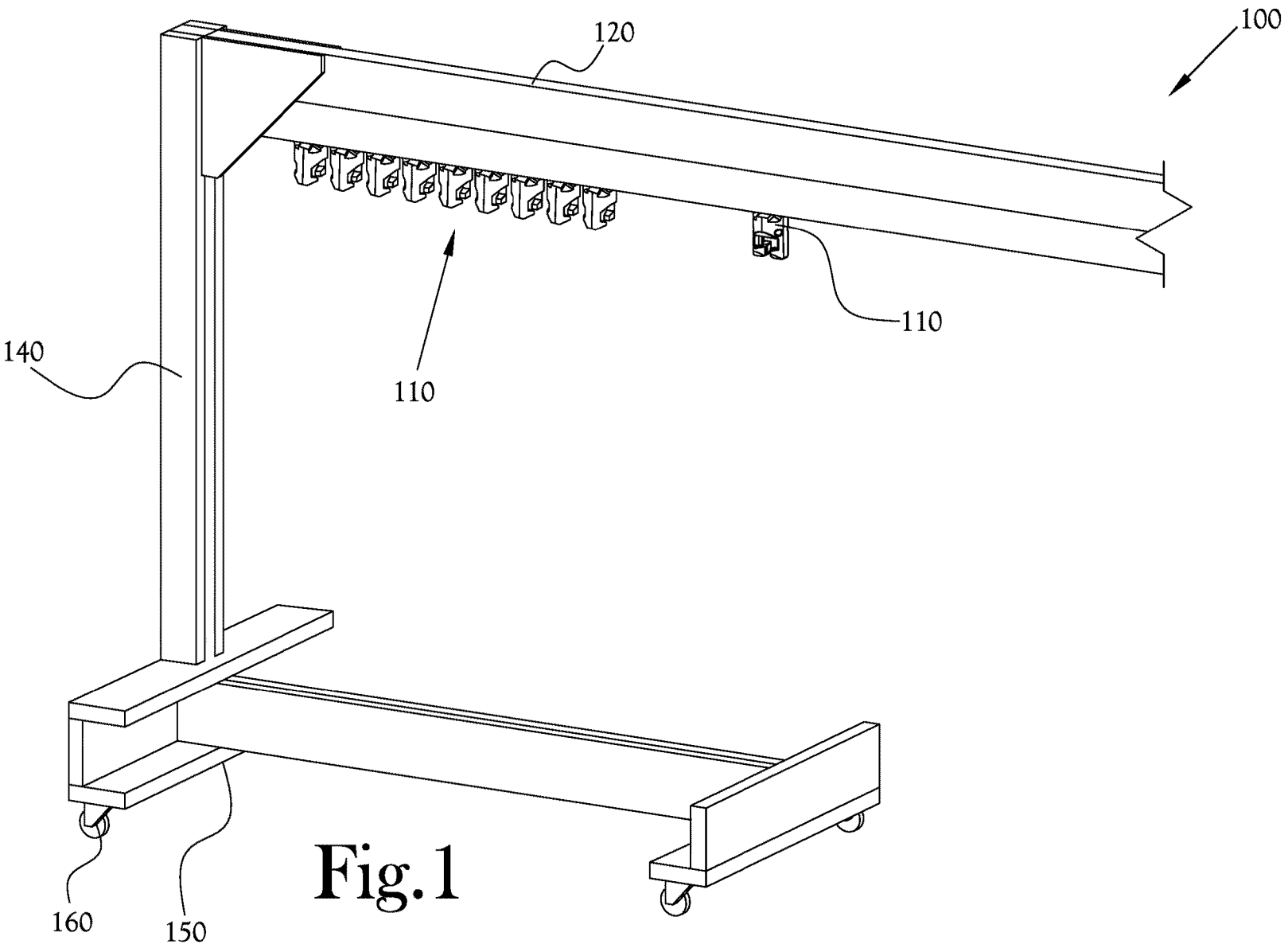
FIG. 1 is a perspective view of a spray rack system according to an example embodiment of the present general inventive concept.

Referring to FIG. 1, example embodiments of the present general inventive concept can be implemented in connection with a rack system for holding multiple movable car members for suspending cabinetry items, which for the purposes of the invention may also include, but is not limited to, other items such as doors or windows. As illustrated in the example embodiment of FIG. 1, a cantilevered rack 100 is shown with multiple slideable, car members 110 attached to its horizontal rail 120. Although FIG. 1 shows 13 car members 110, any number of car members 110 may be utilized subject to the size constraints of the horizontal rail 120. The horizontal rail 120, as shown, may have a rail coupling (described below) so that it can be configured to join securely with other racks 100. A vertical arm 140 is shown which may support the weight of the horizontal rail 120 along with any items being held. The vertical arm 140 is shown attached to a cart 150 with rotatable cart wheels 160. The horizontal rail 120, vertical arm 140, and cart 150 may be constructed of a material strong enough to be able to support the weight of the cabinets, fairly rigid to avoid against undue flex, light weight for easy transportation, and not overly expensive. Two examples of such material are aluminum and steel, although other materials are also possible. Although the cart 150 is shown in FIG. 1 as 2 joists spanned by a cross beam, it is also possible to carry out embodiments of the present general inventive concept using other systems which are configured for supporting and moving the rack. All such configurations and modifications are intended to be included within the scope and spirit of the present general inventive concept.

Figure 2:
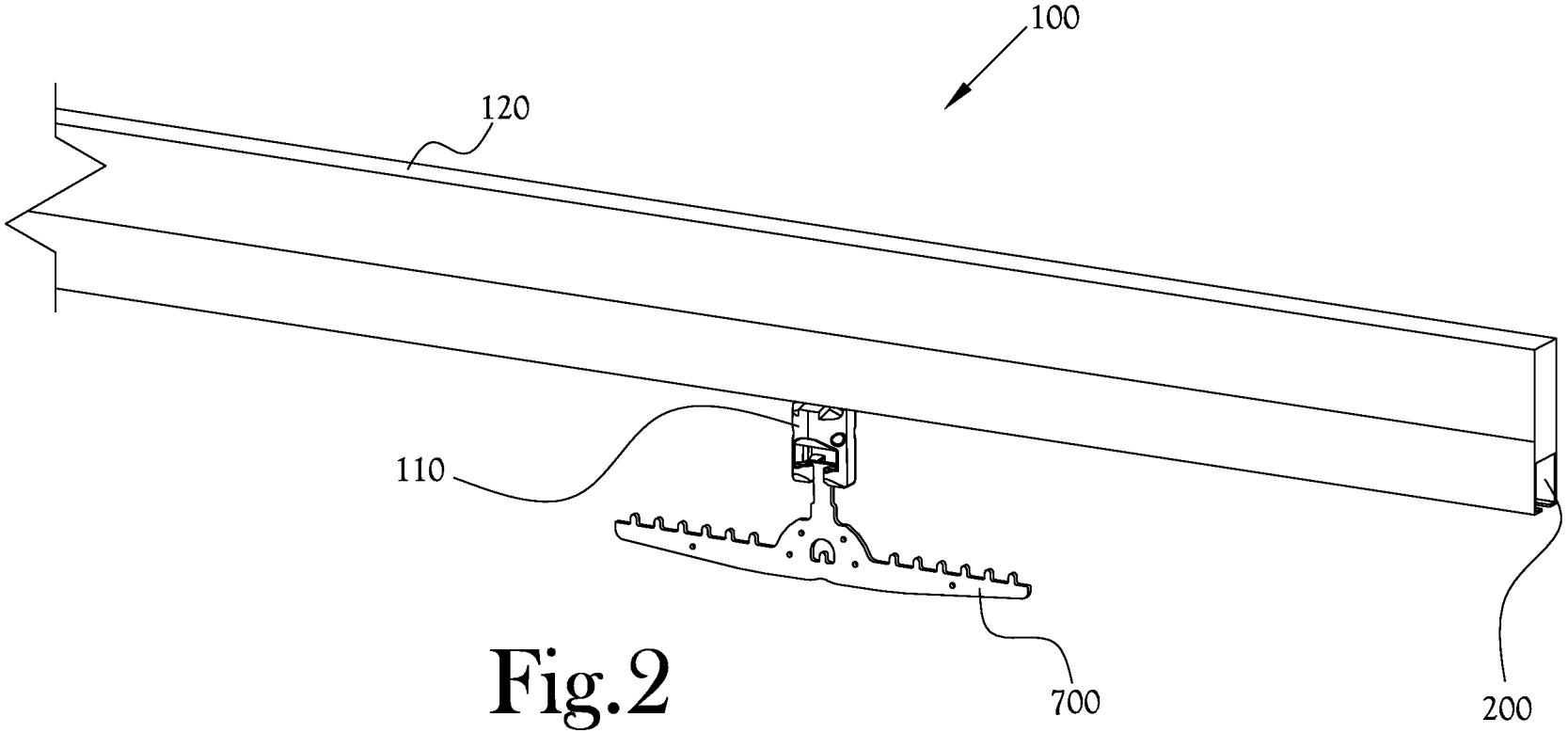
FIG. 2 is a close-up view of a horizontal rail of a spray rack system, according to an example embodiment of the present general inventive concept.

FIG. 2 is a close-up view of the horizontal rail 120 with multiple car members 110 shown attached to the horizontal rail 120. Multiple attachment devices (shown in subsequent figures) can be specialized for cabinet components, and are used to suspend cabinet components and other objects from the rack 100. Included amongst these attachment devices may be a drawer front holder 400, a shelf holder 300 and a hanger 700. Further description of these devices will be provided in the description below. Also shown in the close up view of FIG. 2 is a cut out view of the horizontal rail 120, showing the channel 200 within which the car members 110 may be suspended, and within which they may move in a lateral direction. Although not shown in FIG. 2, in an example embodiment, a stop may be placed at the end of the horizontal rail 120 in order restrain the car members 110 in a lateral direction. Such embodiment will be described in a subsequent paragraph below.

Figure 3B:
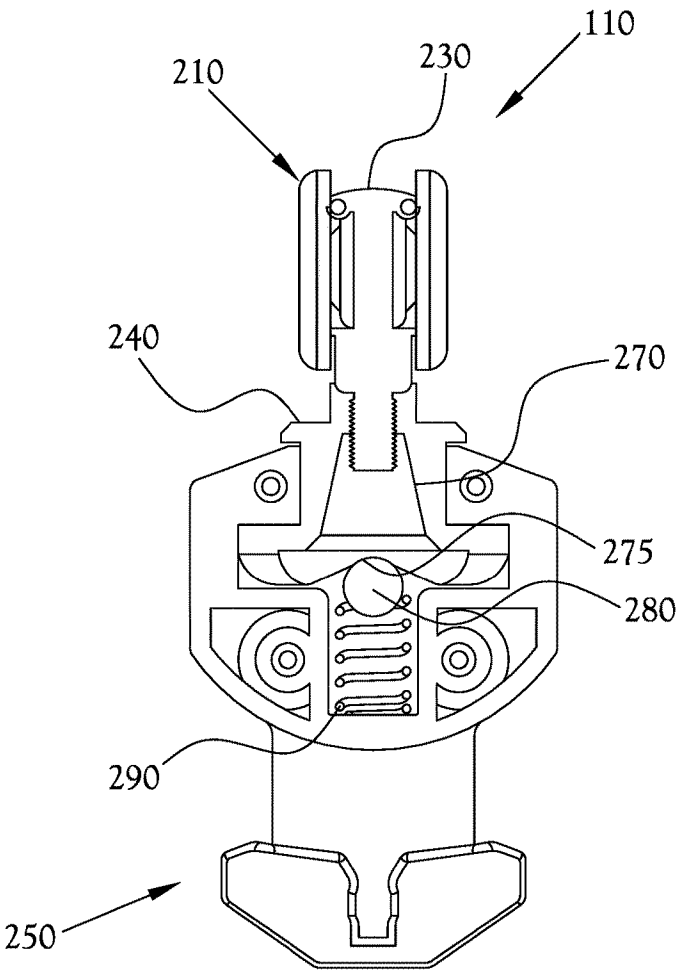
FIG. 3B is a front, internal view of a car member, according to an example embodiment of the present general inventive concept.
Figure 3A:
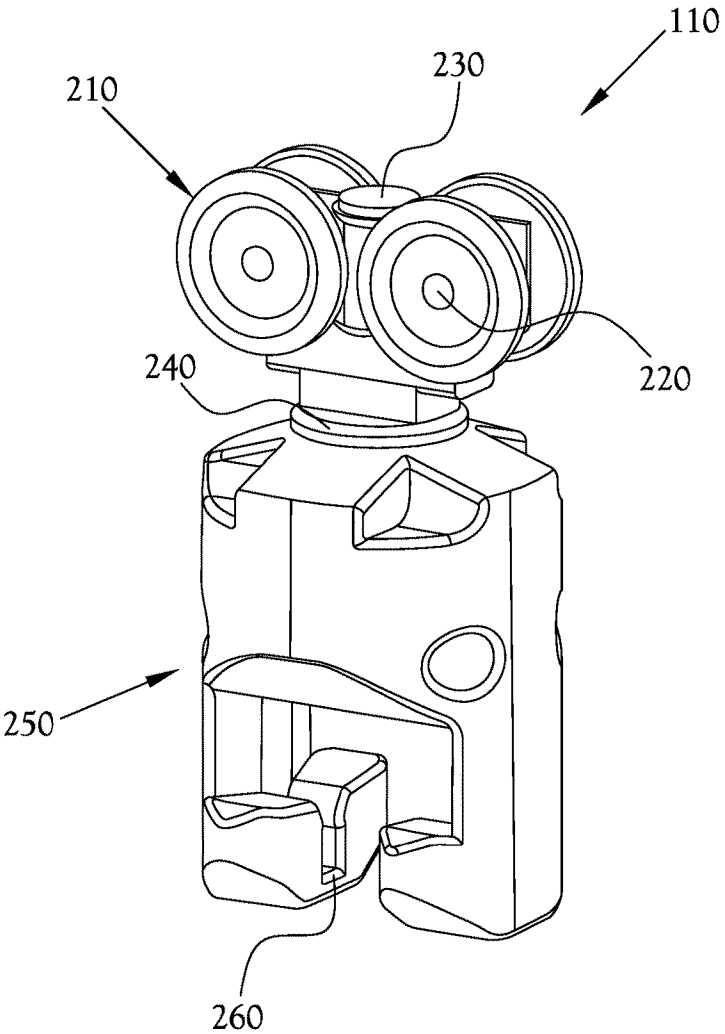
FIG. 3A is a perspective view of a car member, according to an example embodiment of the present general inventive concept.

FIGS. 3A and 3B show different views of the car members 110. FIG. 3A shows a perspective view of a car member 110. The car member wheels 210 are configured to hang and roll within the channel 200 of the horizontal rail 120. It may be useful for the car member wheels 210 encounter enough resistance within the channel 200 such that the cabinet components do not move under the force of the spray finishing. Additionally, wheel brakes (not shown) may be utilized to resist the movement of the car members 110 and the cabinet components in a lateral direction once a desired position is reached. The car member wheels 210 may be attached to each other with axles 220, and the car member wheels 210 and axles 220 attached to a spindle 230. The car member wheels 210, axles 220 and spindle 230 (or "upper assembly") may be configured to rotate on a platform 240 in relation to the lower assembly 250. In one embodiment of the invention, the lower assembly 250 may rotate in 4 distinct positions relative to the upper assembly, in 90 degree increments, to provide easy access to the cabinet components for finishing and also to resist movement in a circumferential direction. However, it also possible in other embodiments to have more or less than 4 distinct positions subject to physical size constraints. In addition to the rotation as described herein, the car members 110 may also pivot in relation to the horizontal plane, in order to limit the amount of running paint or other finish and to allow proper drying, for example. Additionally, the car members 110 may include a spring system to enable staggered height of adjacent cabinet components or doors. Also shown in FIG. 3 are the lower grooves 260, which may be configured to accept the multiple attachment devices, and which may include the drawer front holder 400, the shelf holder 300, and the hanger 700. A foam pad may also be provided for use with the rack system 100 to pad between cabinet components after they have dried, and the foam pad may be attached to the car members 110 as by a magnet, hook or other attachment structure.

FIG. 3B shows an internal view of a car member 110 including one embodiment of a mechanism for providing the distinct positions of rotation between the lower assembly 250 and the upper assembly. The upper assembly including the spindle 230 are shown attached to a hat 270 with multiple detents 275 cut into the brim of the hat 270. The detents 275 may be spaced in a circumferential direction around the brim of the hat 270 and correspond with the distinct rotation positions of the lower assembly 250 relative to the upper assembly. A pin 280 may rest matingly within the detents 275 of the hat 270. A spring 290 may be in physical contact with the pin 280, and the spring force may bias the pin 280 in an upward direction. Rotation of upper assembly including the spindle 230 in either a clockwise or counterclockwise direction rotates the hat 270, applies a downward force on the spring and moves the pin 280 out of the detent 275 of the hat 270 within which it was resting, until the pin 280 finds an adjacent detent within which it can rest. Although there may be any number of detents 275 cut into the brim of the hat 270 subject to the physical size constraints of the hat 270, pin 280, and detent 275, in one embodiment the detents 275 are spaced in equal increments apart such that they provide equal access to surface features of the cabinet components.

Figure 3C:
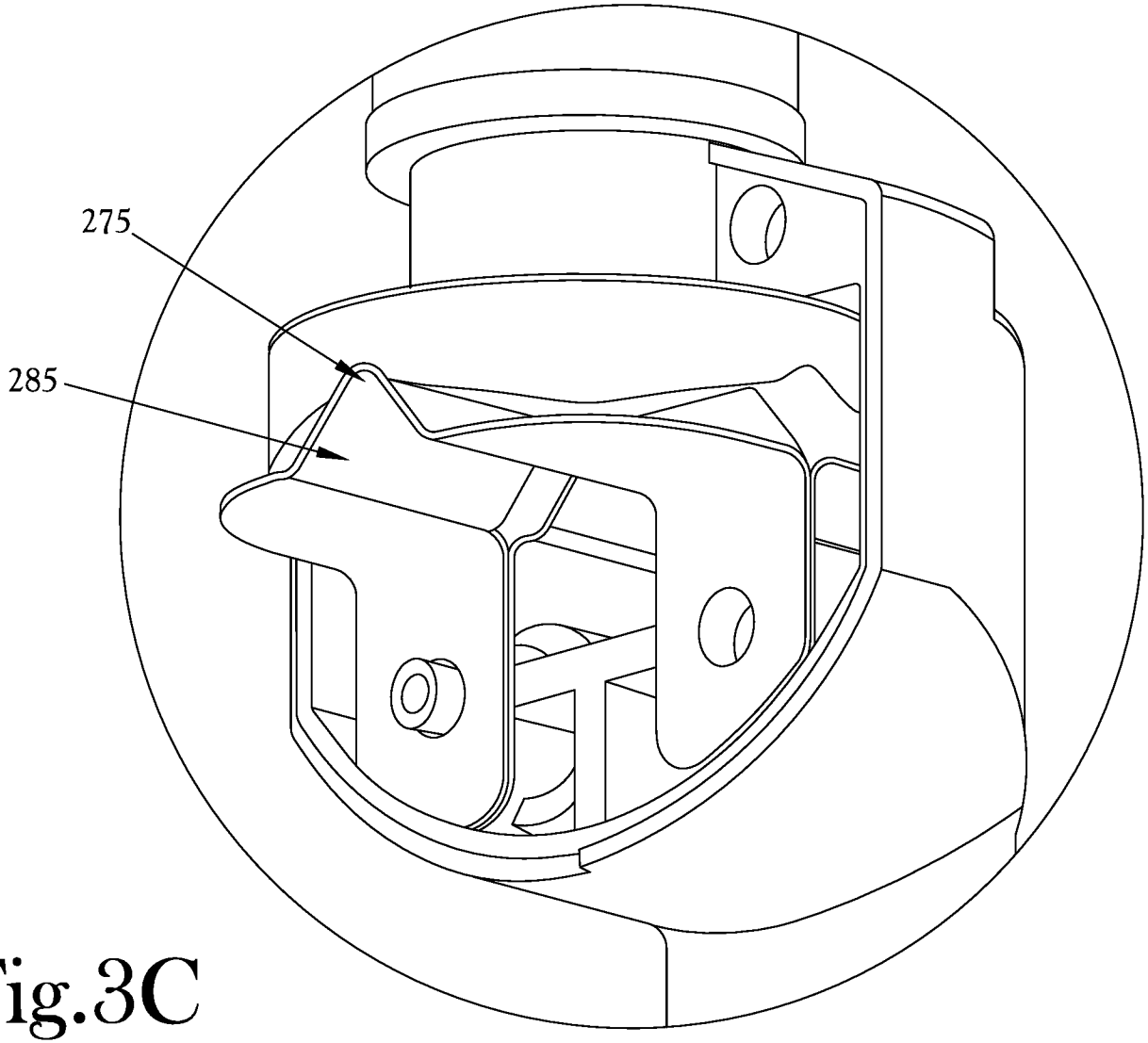
FIG. 3C is a perspective view of a car member, according to an example embodiment of the present general inventive concept.

FIG. 3C shows an alternative embodiment of the car member 110 including one embodiment of a mechanism for providing the distinct positions of rotation between the lower assembly 250 and the upper assembly. In this embodiment, internal spring plates 285 rest matingly within the detents 275 of the hat 270, while intermediate positions between the detents 275 deflect the internal spring plates 285 in a downward direction.

Figure 4:
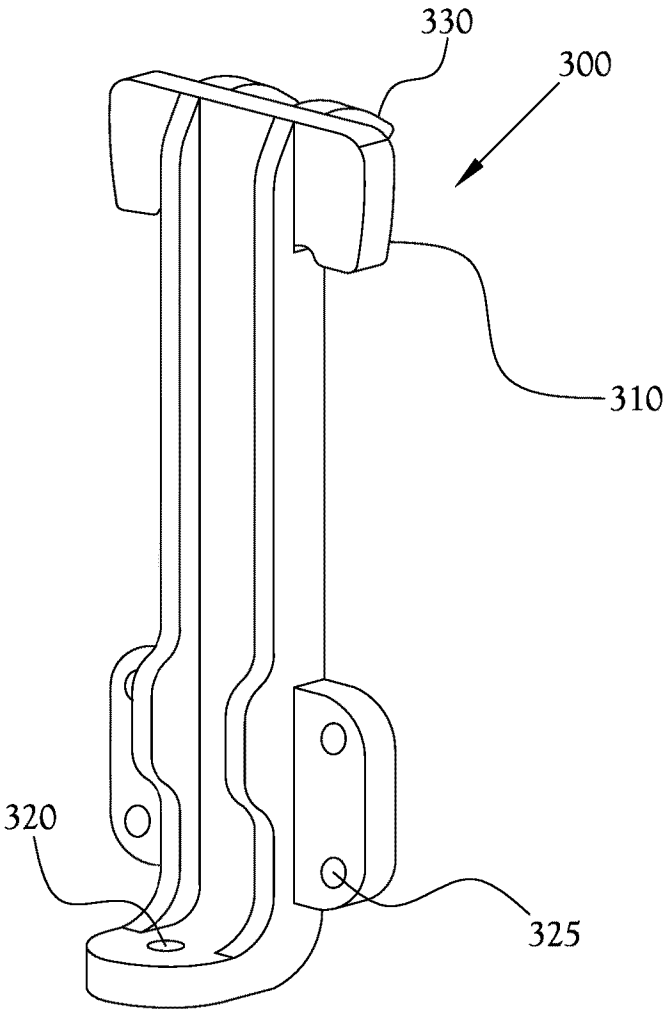
FIG. 4 is a perspective view of a shelf holder, according to an example embodiment of the present general inventive concept.

FIG. 4 shows a perspective view of a shelf holder 300 configured for holding a shelf securely within the rack 100. Two side tabs 310 are configured to fit matingly within the lower grooves 260 of the car members 110. Additionally, a rear tab 330 with a corresponding hole may be used to attach to a hanger 700 when used with at least one other shelf holder 300, as described in a subsequent paragraph. At the lower end of the shelf holder 300 is a bottom hole 320 of sufficient size to accept a wood screw. In one embodiment of the invention, the bottom hole 320 may be used to screw into a hidden edge of a cabinet shelf in order to support the shelf for spray finishing. Also shown in FIG. 4 are additional side holes 325 which may be used for attachment to the cabinet shelf, for other cabinet components, or any other object for spray finishing. The multiple side holes 325 may provide a more secure attachment, as opposed to a single bottom hole 320.

Figure 5:
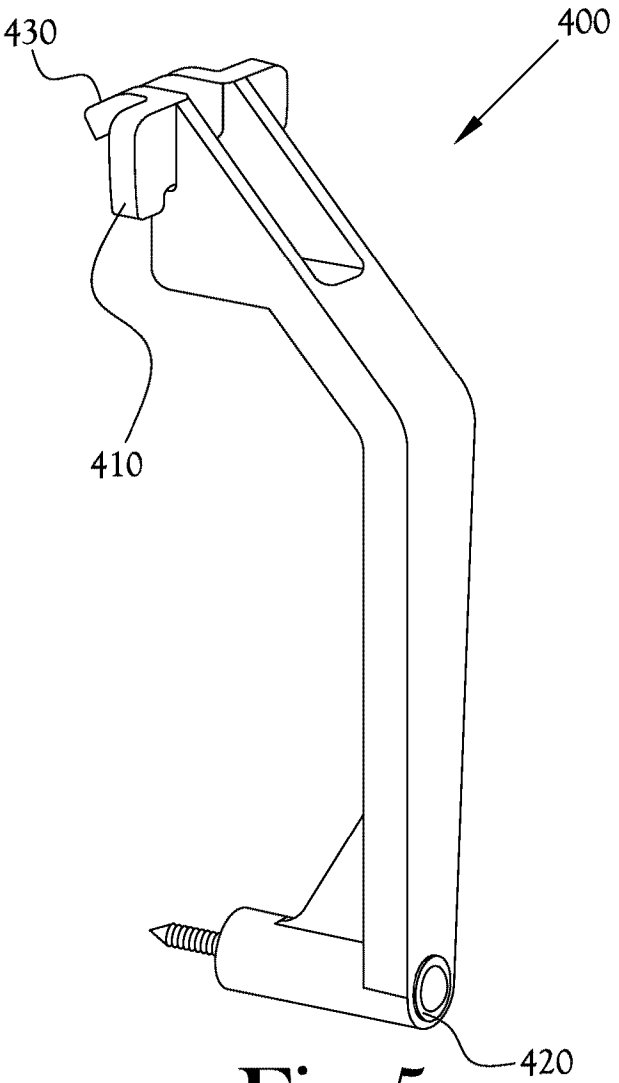
FIG. 5 is a perspective view of a drawer front holder, according to an example embodiment of the present general inventive concept.

FIG. 5 shows a perspective view of a drawer front holder 400 configured for holding a drawer securely within the rack 100. Two side tabs 410 are configured to fit matingly within the lower grooves 260 of the car members 110. Additionally, a rear tab 430 with a corresponding hole may be used to attach to a hanger when used with at least one other drawer front holder 400, as described in a subsequent paragraph. At the lower end of the drawer front holder 400 is a bottom hole 420 of sufficient size to accept a wood screw. In one embodiment of the invention, the bottom hole 420 may be used to screw into a hidden area, for example on the back of the drawer front, in order to support the drawer for spray finishing.

Figure 6:
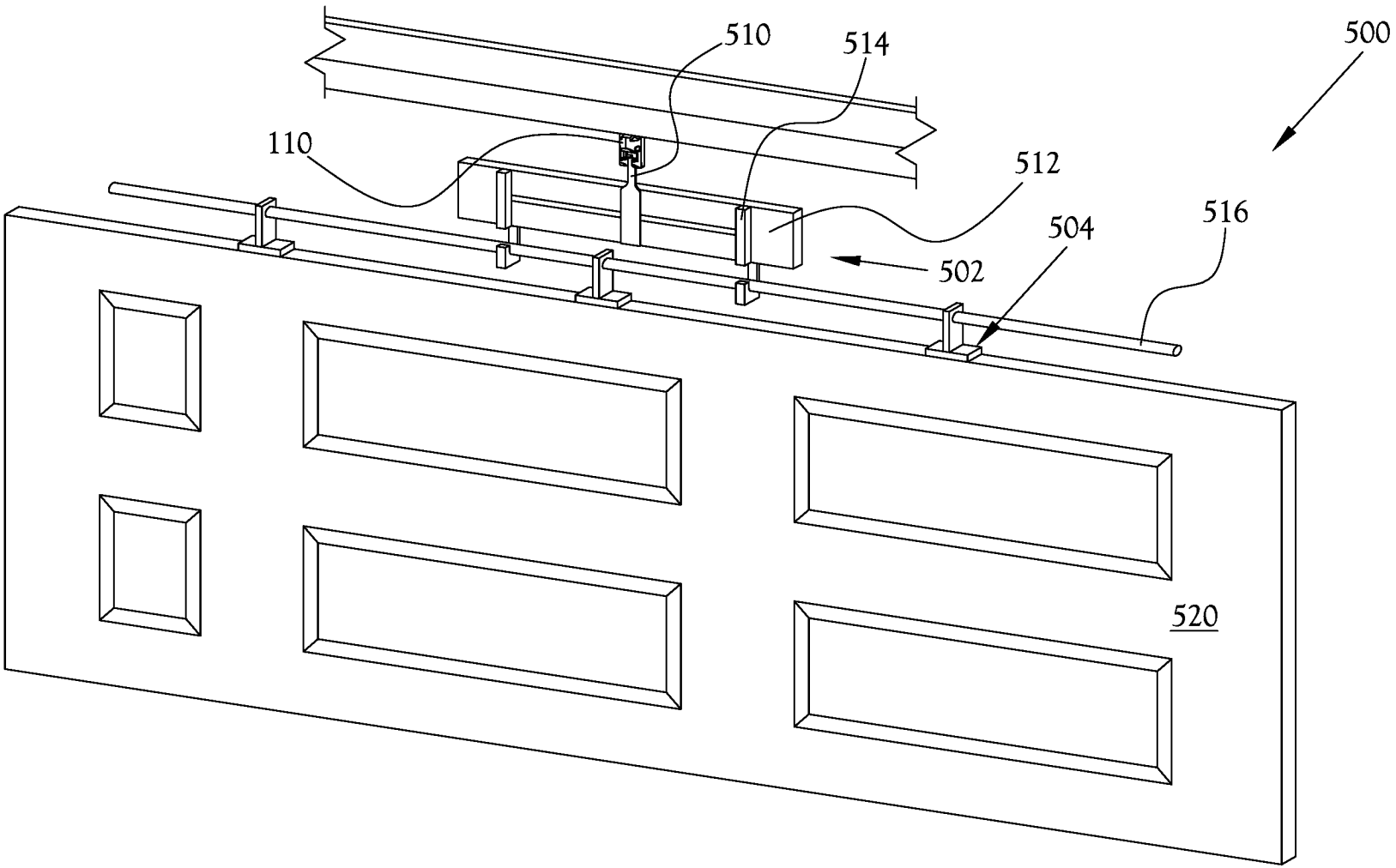
FIG. 6 is a perspective view of a door holder along with an attached door, according to an example embodiment of the present general inventive concept.

FIG. 6 shows a perspective view of a door holder 500 with attached door 520. The door holder 500, may consist of 2 distinct components, the door hanger 502 and one or more blocks 504, and a pipe 516 which can be inserted through holes in blocks 504. The door hanger 502 may include a center brace 510 which serves as the connection between the car member 110 and the door holder 500. The center brace 510 has two tabs (not shown) which fit matingly within the lower grooves 260 of the car members 110. The door hanger 502 may also include a support plank 512 and two or more hooks 514. The hooks 514 are attached to the support plank 512. In the embodiment shown in FIG. 6, slats are shown cut into the support plank 512. By loosening the screws connecting the hooks 514 to the support plank 512, an operator would then be able to move the hooks 514 in a lateral direction to provide for quick adjustment of the balance of the door 520 prior to spray refinishing. The blocks 504 may attach to the door 520 in the area of the hinge cutouts of the door 520, which will be hidden from view once the hinges are installed or reattached. A pipe 516 is inserted through holes in the blocks 504, and the door 520 may then be suspended onto the hooks 514 prior to refinishing of the door 520. The pipe 516 may be made of steel, wood, or other solid material. In another embodiment, an expandable hole mount (shown as 600 in FIG. 7) that fit into the knob hole of the door 520, may be used to suspend the door 520 from the rack 100. Although the door hanger 502 may be made of wood as shown in FIG. 6, other materials are also possible, for example aluminum or steel.

Figure 7B:
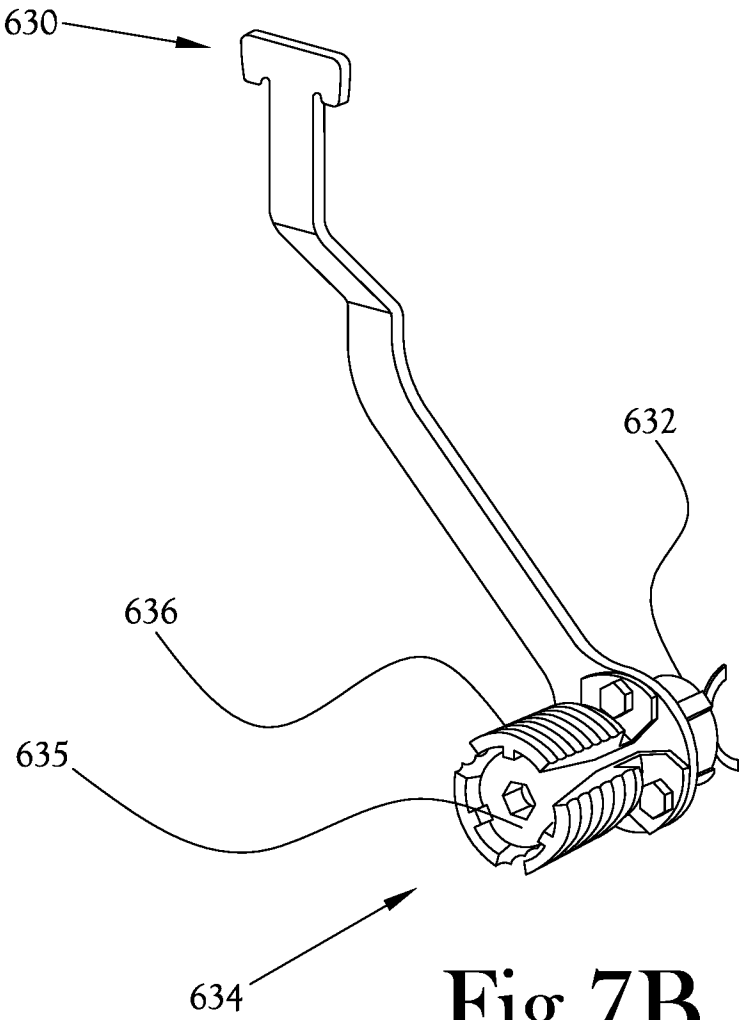
FIG. 7B is a front view of an expandable hole mount, according to an example embodiment of the present general inventive concept.
Figure 7A:
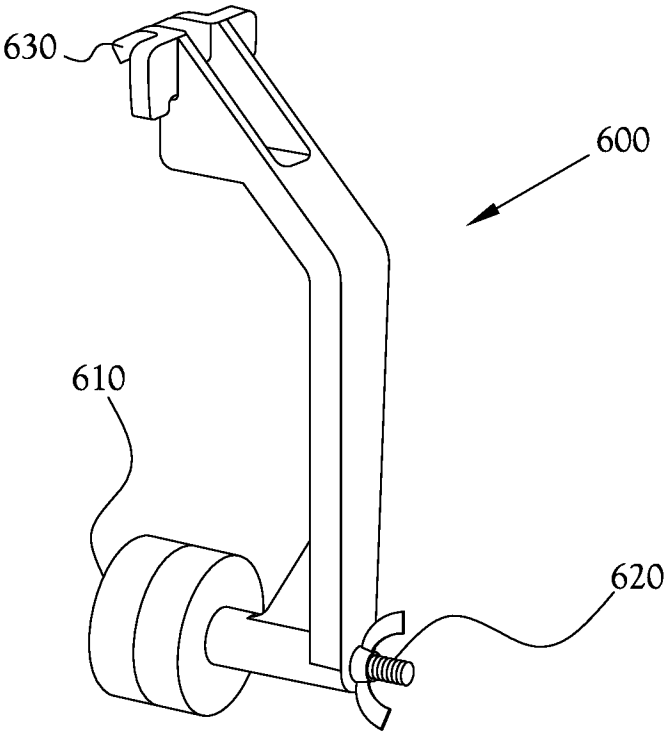
FIG. 7A is a front view of an expandable hole mount, according to an example embodiment of the present general inventive concept.

FIG. 7A shows an illustration of the expandable hole mount 600, which may be used to attach to a door knob opening, or other opening in a cabinet component or other object. The expandable hole mount 600 can act in the same fashion as the other attachment devices described above, which can be used to suspend cabinet components and other objects from the rack 100. The expandable hole mount 600 consists of a prior art expandable plug 610, with an actuation device 620, shown as a wing nut in FIG. 7A, but which could also be a lever, handle, knob, etc. Actuation of the expandable plug 610 creates a tight fit within a door knob opening, or other opening in a cabinet component or other object, and creates a secure attachment point. On the other end of the expandable hole mount 600 are two side tabs 630 which are configured to fit matingly within the lower grooves 260 of the car members 110. FIG. 7B shows an alternate embodiment of the expandable hole mount 600. In this embodiment, a screw knob 632 is rotated to actuate expanding core components 634 which may be used to attach to a door knob opening, or other opening in a cabinet component or other object. The expanding core components 634 consist of an inner block 635 and a sleeve 636 and rotation of the inner block 635 by rotating the screw knob 632 causes the sleeve 636 to move in an outward direction, which can cause it to provide a secure attachment within the knob hole of a door 520.

Figure 8:
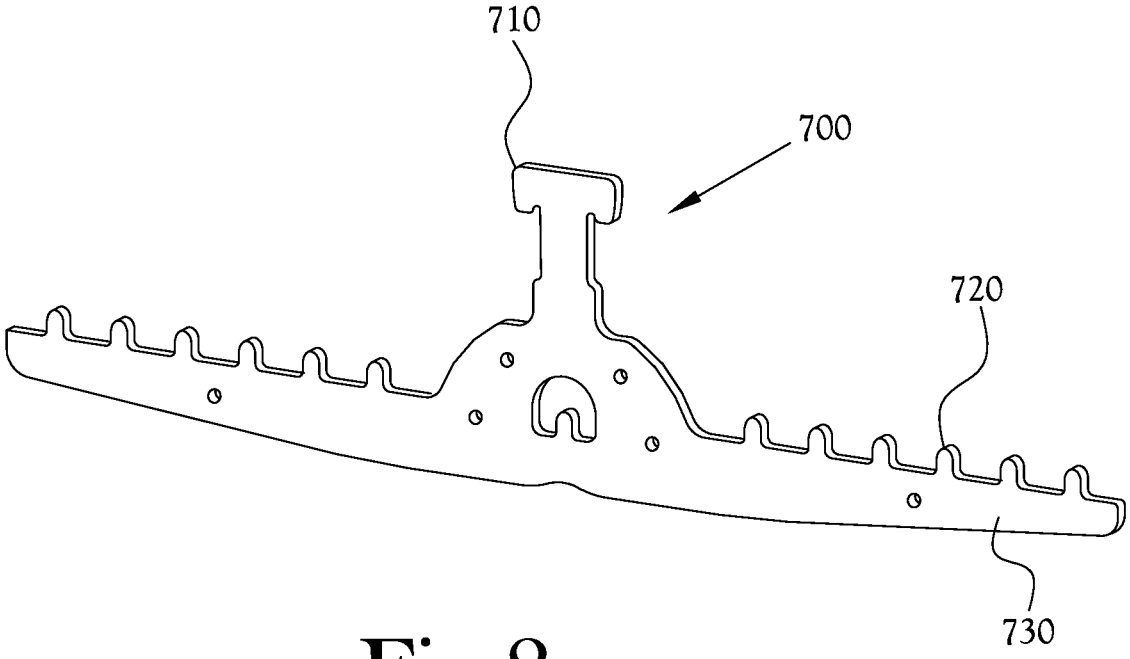
FIG. 8 is a front view of a hanger, according to an example embodiment of the present general inventive concept.

FIG. 8 shows a hanger 700 which can be used to suspend cabinet components and other objects from the rack 100. The hanger 700 can come in different sizes based on the size of the cabinet component or other object it is intended to support. At the top of the hanger 700 are two side tabs 710 which are configured to fit matingly within the lower grooves 260 of the car members 110. Also located on the hanger 700 are multiple upward tabs 720, which are generally equally spaced apart across the hanger rail 730, and which can be used with finishing clips (shown as 810 in FIG. 9). Additional embodiments may include a custom hangar 700 with multiple holes in different locations to support an operator created configuration.

Figure 9:
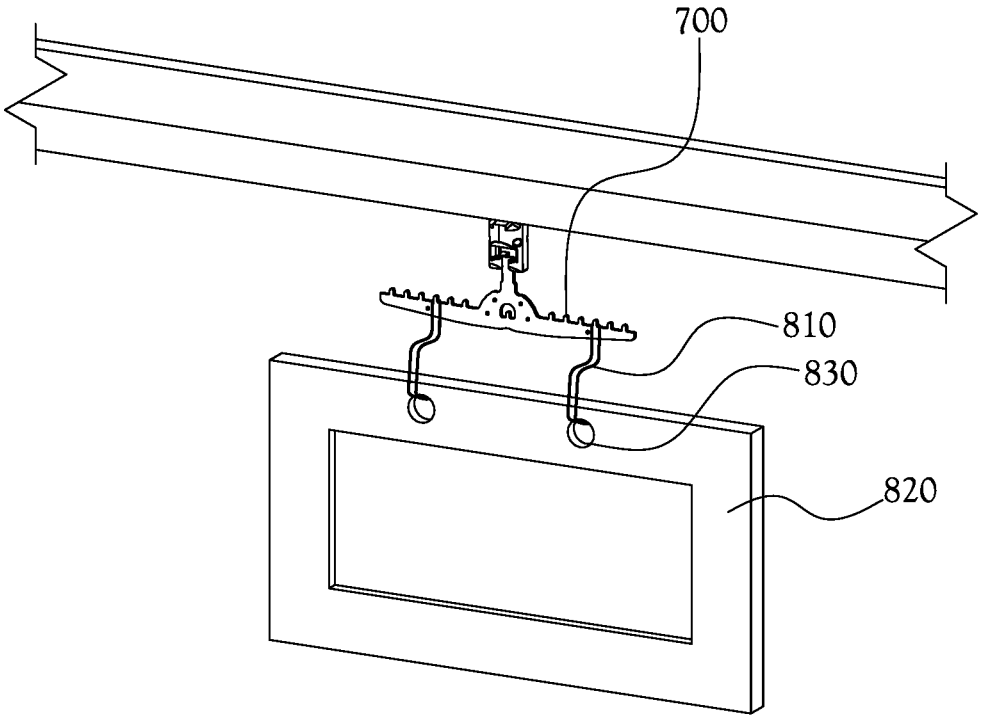
FIG. 9 is a perspective view of a finishing clip, being used in conjunction with a hanger, according to an example embodiment of the present general inventive concept.

FIG. 9 shows the hanger 700 being used in conjunction with the finishing clips 810 to support a cabinet door 820 from the rack 100. The upper end of the finishing clips 810 may form a loop which can hang over the upward tabs 720, and the upward tabs 720 resist movement of the finishing clips 810 and cabinet door 820 or other object in a lateral direction. The bottom end of the finishing clips 810 may form a hook which can fit within the hole 830 of the cabinet door 820 or other object in order to secure the cabinet door 820 or other object prior to and during spray finishing. Given their generally looser fit within a hole 830 of the cabinet door 820 or other object, in comparison with the expandable plugs 610 described above, the finishing clips 810 are intended to be used in pairs with the hanger 700.

Figure 10A:
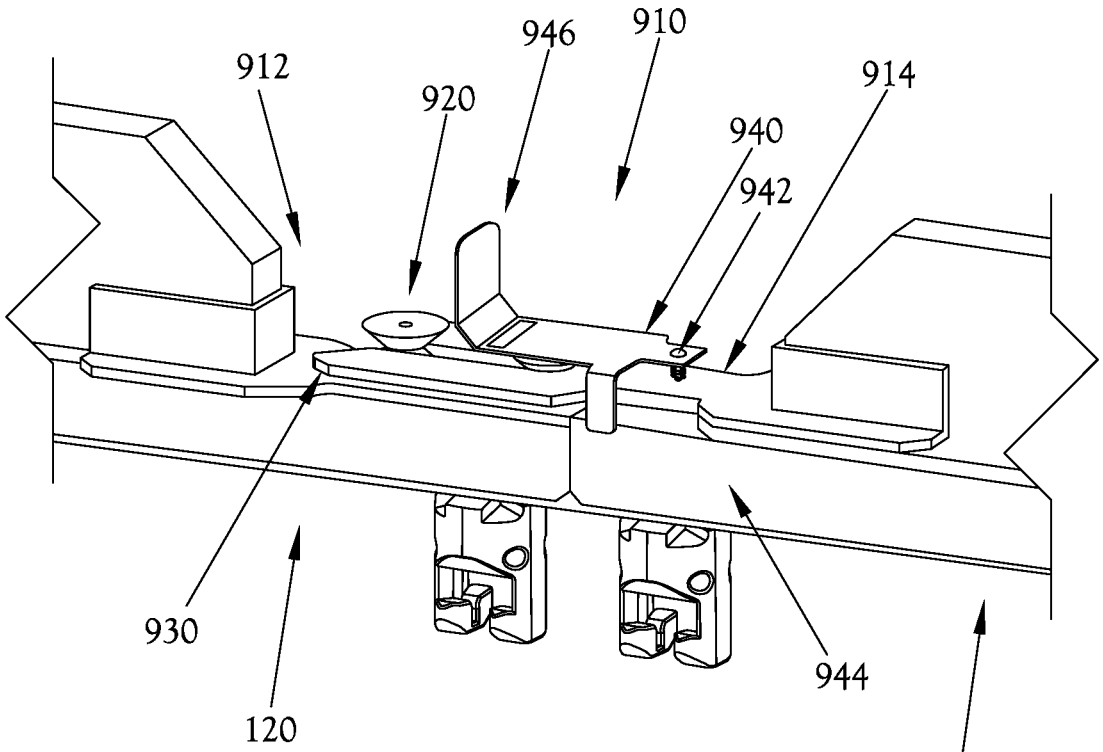
FIG. 10A is a top view of a rail coupling, according to an example embodiment of the present general inventive concept.

FIG. 10A shows a rail coupling 910 which allows a rack 100 to be configured to join securely with other racks 100. The horizontal rail 120 of each rack 100 is shown on the right and left of FIG. 10. The rail coupling 910 may be composed of two distinct parts, the spool coupler 912 and the fork coupler 914. These two parts join together to provide for proper alignment and attachment of the two racks 100. Also shown in FIG. 10A are the spools 920, fork 930, latch 940, and latch release handle 946. A latch limiting and adjustment screw 942 allows the user to adjust the latch for a secure fit. A side plate 944 is configured to overlap the horizontal rail 120 when the horizontal rails 120 are in a coupled state (as shown in FIG. 10A), in order to promote proper alignment of the horizontal rails 120.

Figure 10B:
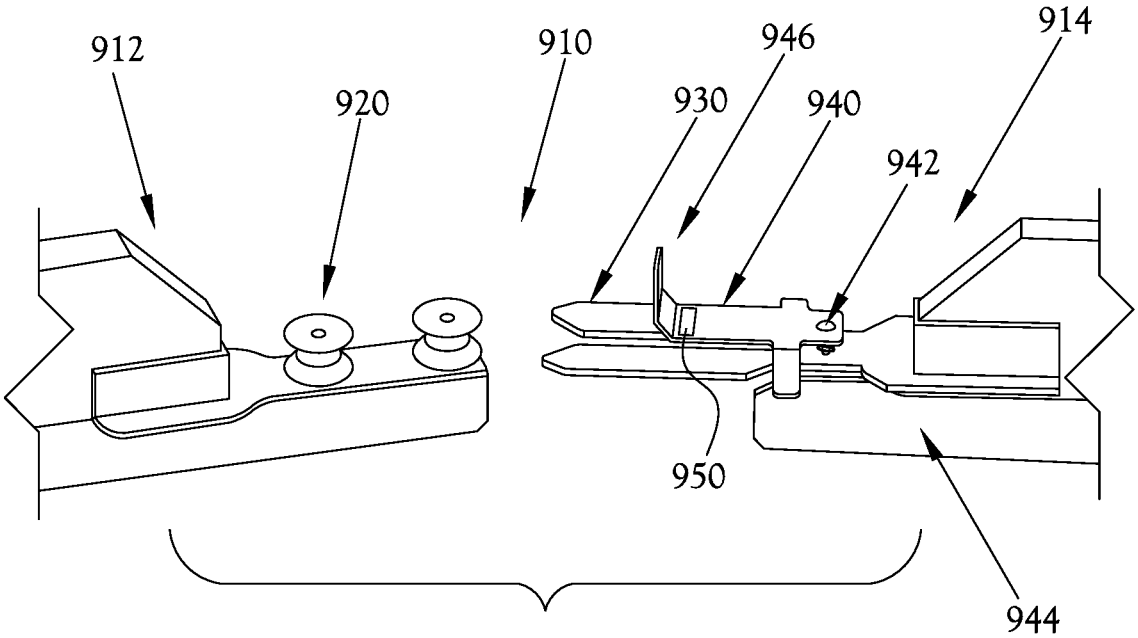
FIG. 10B is a front view of a rail coupling, according to an example embodiment of the present general inventive concept.

FIG. 10B shows a view of the spool coupler 912 and the fork coupler 914 in an uncoupled state. As the spool coupler 912 and the fork coupler 914 are advanced towards each other, the spools 920 are inserted between the arms of the fork 930, providing for proper alignment of the two racks 100. A latch tab 950 may be configured to mate with one of the spools 920, so that once the spools 920 are fully inserted between the arms of the fork 930, and the horizontal rail 120 ends meet up, the latch tab 950 engages with the spool 920 creating a locking fit. Moving the latch 940, by means of the latch release handle 946 in a vertical direction releases the rail coupling 910. FIG. 10A shows the engaged position of the two racks 100.

Figure 10C:
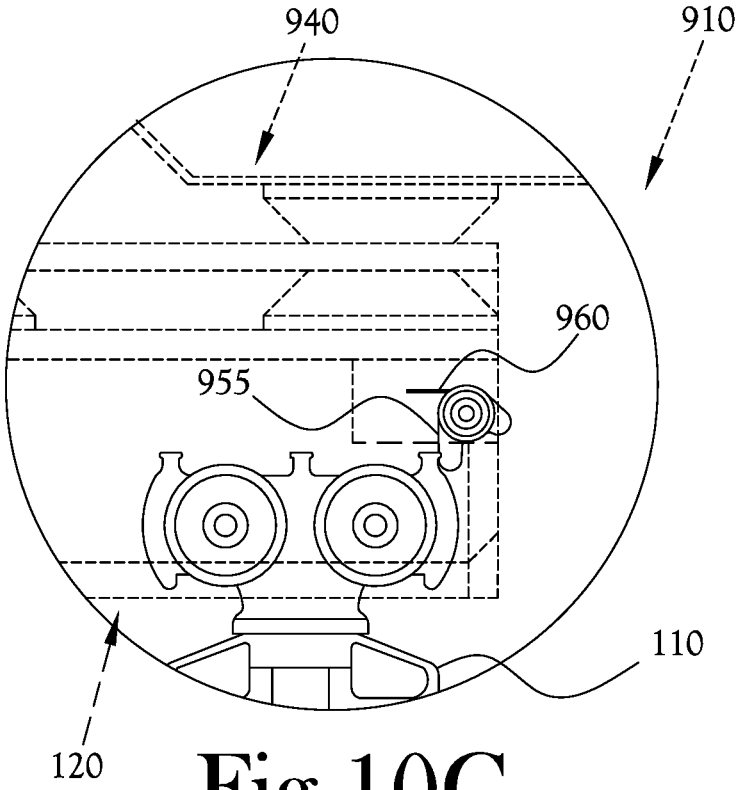
FIG. 10C is an interior view of a rail coupling, according to an example embodiment of the present general inventive concept.

Shown in FIG. 10C is an interior view of the distal end of the horizontal rail 120. A stopper cam 955 is shown attached near the end of the horizontal rail 120. The stopper cam 955 has a limited range of motion in the circumferential direction and serves to prevent the car members 110 from rolling off the ends of the rack 100 when uncoupled. As shown in FIG. 10C, with the car member 110 resting against the stopper cam 955 near the end of the horizontal rail 120, the stopper cam 955 has reached the limit of its range of motion in the counter-clockwise direction, and the car members 110 is prevented from rolling off the ends of the rack 100. A torsion spring 960 is attached to the stopper cam 955 in order to bias the stopper cam 955 in a position so that it contacts the car member 110 as the car member 110 approaches the end of the of the horizontal rail 120, when the rack 100 is in an uncoupled state.

Figure 10D:
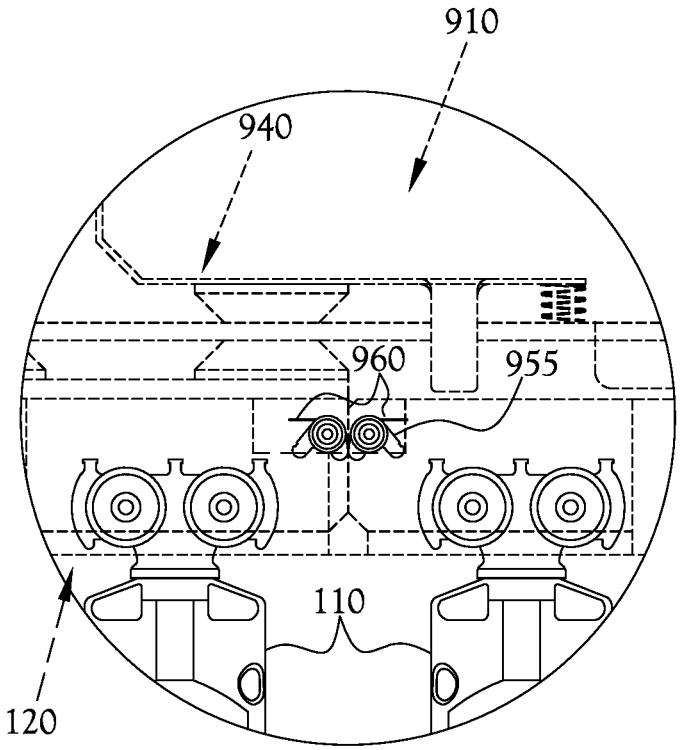
FIG. 10D is an interior view of a rail coupling, according to an example embodiment of the present general inventive concept.

FIG. 10D shows an interior view of the distal end of the horizontal rails 120 in a coupled state. In this case, the stopper cams 955 rotate against the biasing force of the torsion spring 960 and are no longer in position to engage with a car member 110 as it approaches the end of the of the horizontal rail 120. Thus, when the rack 100 is in a coupled state, the car members 110 can move freely between racks 100.

Figure 10E:
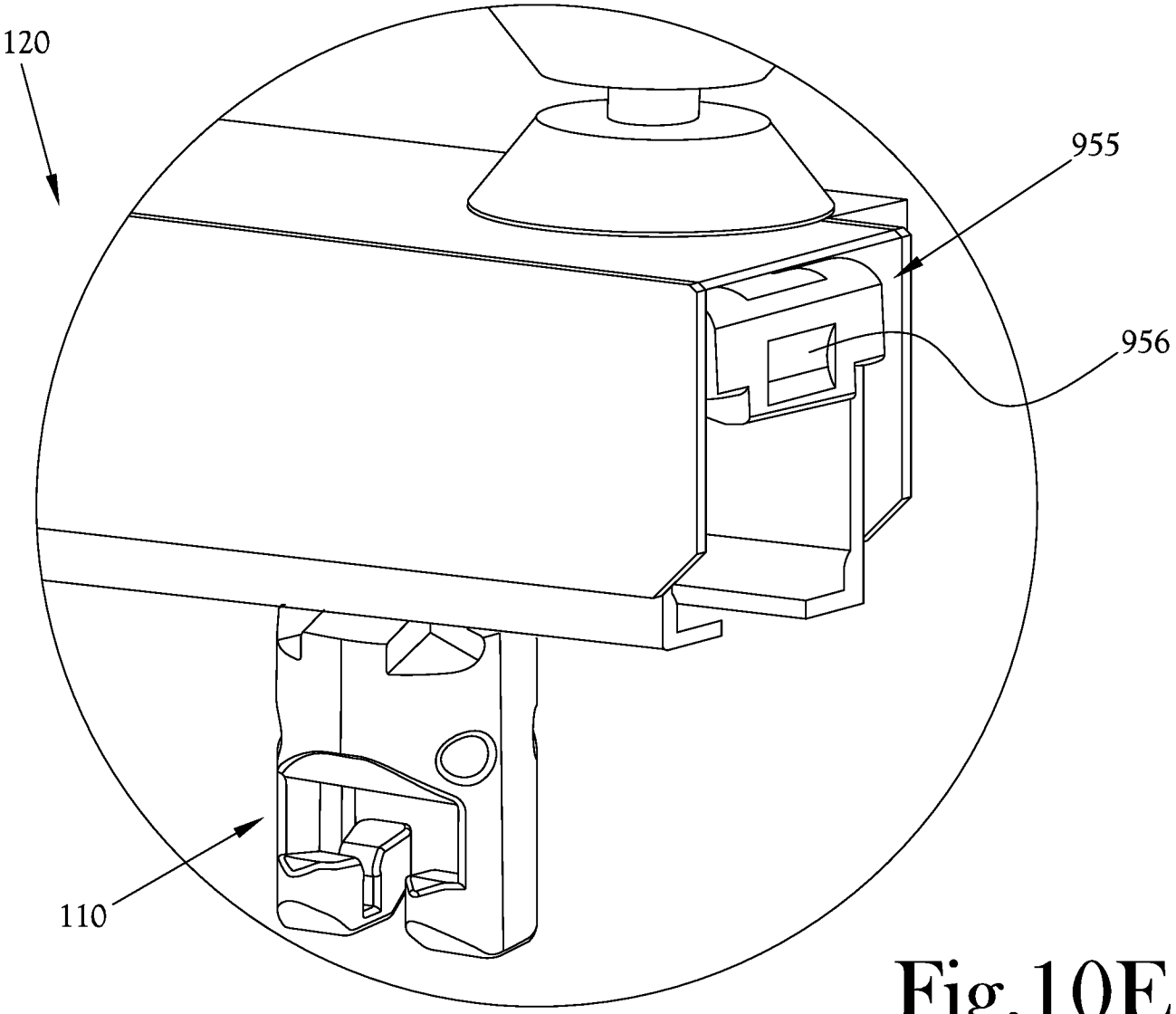
FIG. 10E is a perspective view of a rail coupling, according to an example embodiment of the present general inventive concept.

FIG. 10E shows a view of one end of a horizontal rail 120 when the rack 100 is in an uncoupled state, including a stopper cam finger relief 956. By depressing the stopper cam finger relief 956, the stopper cam 955 is no longer in position to engage with a car member 110 as it approaches the end of the of the horizontal rail 120, and may be used to manually remove a car member 110, for example to service it.

In one embodiment of the present general inventive concept, a rack 100 as shown in FIG. 1 attached to a movable cart 150 may be coupled to a fixed rack 100 in order to provide a stable platform during the spray finishing process. The fixed rack 100 may be attached to a wall, ceiling, or other immovable surface. After suspending the cabinet component(s) from the car member 110 of the rack 100 attached to a movable cart 150, the rack 100 may then be moved into position in line with the fixed rack 100. The spool coupler 912 of one rack 100 may then be joined with the fork coupler 914 on the other rack 100 until they are locked in place, in order to provide a substantially pivot-free connection. At that point, the operator may proceed with spray finishing of the cabinet components. In one embodiment, one rack 100 may be used to spray a cabinet component, after which the sprayed and dried cabinet component may be loaded onto the other rack 100 for transport or storage or the like.

Example embodiments include providing systems for retaining and maneuvering cabinetry items from one or more rack systems while applying coatings to the cabinetry items, including providing one or more car members configured to support the cabinetry items, providing one or more attachment devices configured to be removably attachable to the one or more car members and to the cabinetry items, providing a horizontal rail configured to support the one or more car members and to provide a channel for the one or more car members to move in a generally parallel direction with respect to the rail, providing a base configured to support the weight of the rail, one or more car members, and cabinetry items such that the system supports the cabinetry item from the one or more of the attachment devices, and supports the attachment device and cabinetry item from one of the one or more car members such that the cars can be moved along the horizontal rail and rotated until the cabinetry item is in position for spray finishing.

The systems and methods can also include providing a rail coupling attached to the end of one or more horizontal rails to facilitate mating or coupling of one rack system with another to facilitate movement of items to be spray coated from one rack to another.

It is noted that the simplified diagrams and drawings do not illustrate all the various connections and assemblies of the various components, however, those skilled in the art will understand how to implement such connections and assemblies, based on the illustrated components, figures, and descriptions provided herein, using sound engineering judgment.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

While example embodiments have been illustrated and described, it will be understood that the present general inventive concept is not intended to limit the disclosure, but rather it is intended to cover all modifications and alternate devices and methods falling within the spirit and the scope of the invention as defined in the appended claims.

The invention claimed is:

1. A system for retaining and maneuvering items to be spray-coated, comprising:

a first rack having at least a first rail;

one or more car members coupled to the at least first rail such that the one or more car members are configured to move along a first length of the at least first rail and to rotate in multiple distinct positions about an axis perpendicular to the at least first rail;

a second rack having at least a second rail;

a rail coupling configured to mate the at least first rail and the at least second rail to facilitate movement of the one or more car members between the first length of the at least first rail and a second length of the at least second rail, wherein the one or more car members are configured to move along the second length of the at least second rail and to rotate in the multiple distinct positions about the axis when the one or more car members are moved from the first length to the second length; and one or more attachment devices removably attachable to the one or more car members and the one or more items to be spray coated, respectively, such that the one or more items to be spray-coated hang from the at least one rail when the one or more car members are coupled to the at least one rail and the attachment devices are respectively attached to the one or more car members and items to be spray coated.

2. The system of claim 1, wherein the at least first rail and the at least second rail comprise a channel along the first length and the second length, and the car members include one or more wheels configured to hang from and roll within the channel.

3. The system of claim 2, further comprising a base configured to support the at least first rail in a horizontal orientation.

4. The system of claim 3, wherein the one or more car members are configured to rotate in ninety-degree increments about the axis.

5. The system of claim 4, wherein the one or more car members include a lower assembly and an upper assembly, the lower assembly including an attachment point to removably receive the one or more attachment devices, the upper assembly including the wheels, a spindle attached to the wheels, and a hat attached to the spindle, the hat including multiple detents oriented in multiple distinct positions around the hat.

6. The system of claim 5, wherein the lower assembly includes a spring-loaded pin to engage a particular detent to orient the lower assembly at a first position with respect to the upper assembly, and wherein rotation of the lower assembly in relation to the upper assembly forces the spring-loaded pin out of the particular detent, and further rotation of the lower assembly forces the spring-loaded pin to engage an adjacent detent to orient the lower assembly at a second position with respect to the upper assembly.

7. The system of claim 5, wherein the lower assembly includes a spring plate to engage a particular detent to orient the lower assembly at a first position with respect to the upper assembly, and wherein rotation of the lower assembly in relation to the upper assembly forces the spring plate out of the particular detent, and further rotation of the lower assembly forces the spring plate to engage an adjacent detent to orient the lower assembly at a second position with respect to the upper assembly.

8. The system of claim 1, wherein the one or more attachment devices is one of a drawer front holder, a shelf holder, a door holder, a hinge hole mount, and a hanger.

9. The system of claim 8, wherein the hanger is configured to be used with finishing clips which loop around upward tabs on the hanger, the finishing clips being configured to engage holes on a back face of the items to hang the items from the hanger.

10. The system of claim 8, wherein the door holder comprises a screw knob connected to expanding core components such that the expanding core components expand within a door knob opening of a door to be spray-coated so as to attach the door to the door holder when the screw knob is rotated.

11. The system of claim 8, wherein the hinge hole mount comprises an expandable plug and an actuation device to secure the expandable plug to a hinge hole of the item to be spray-coated upon actuation of the actuation device.

12. The system of claim 1, wherein the one or more attachment devices are configured to fit matingly to the one or more car members when the one or more attachment devices are attached to the one or more car members to inhibit movement of the one or more attachment devices relative to the one or more car members.

13. A system for retaining and maneuvering items to be spray-coated, comprising:

one or more movable racks each having a first horizontal rail to support a plurality of items to be spray-coated, the first horizontal rail including a first channel disposed along a length of the first horizontal rail;

one or more car members coupled to the first horizontal rail such that the one or more car members are configured to move along the first channel of the first horizontal rail and to rotate in multiple distinct positions about an axis perpendicular to the length of the first horizontal rail;

one or more attachment devices removably attachable to the one or more car members and the one or more items to be spray coated, respectively, such that the one or more items to be spray-coated hang from the first horizontal rail when the one or more car members are coupled to the first horizontal rail and the attachment devices are respectively attached to the one or more car members and items to be spray coated;

a movable base configured to support the first horizontal rail; and one or more fixed racks each having a second horizontal rail, the second horizontal rail including a second channel disposed along a length of the second horizontal rail, the second channel being configured to mate with the first channel to facilitate movement of one or more of the car members between the first channel and the second channel.

14. The system of claim 13, wherein the one or more fixed racks are attached to a ceiling or wall.

15. The system of claim 13, wherein the fixed racks and movable racks include mating rail couplings to respectively couple a particular fixed rack to a particular moveable rack.

16. The system of claim 15, wherein the rail coupling on the fixed racks and the rail coupling on the movable racks each contain a stopper cam which prohibits cars from coming off the rails when the racks are uncoupled, and provides free movement of the cars between racks when the racks are coupled.

17. A system for retaining and maneuvering items to be spray-coated, comprising:

a rack having at least one rail; and one or more car members coupled to the at least one rail such that the one or more car members are configured to move along a length of the at least one rail and to rotate in multiple distinct positions about an axis vertically perpendicular to the length of the at least one rail, wherein the one or more car members include an attachment structure configured to removably attach the one or more car members to one or more items to be spray-coated such that the one or more items to be spray-coated hang from the at least one rail when the one or more car members are coupled to the at least one rail; and wherein the one or more car members comprise a rotation mechanism configured to rotate the car member into the multiple distinct positions about the axis such that at least one of the multiple distinct positions is oriented so as to orient a planar surface of at least one of the items to be spray coated parallel to the axis and perpendicular to the at least one rail.

18. The system of claim 17, wherein the attachment structure is configured to matingly receive an attachment device connected to the one or more items to be spray coated.

* * * * *